US008715896B2

(12) United States Patent
Wu

(10) Patent No.: US 8,715,896 B2
(45) Date of Patent: May 6, 2014

(54) POLYALKYLENE GLYCOL BENZOATE CONTAINING PHOTOCONDUCTORS

(75) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 417 days.

(21) Appl. No.: 13/016,179

(22) Filed: Jan. 28, 2011

(65) Prior Publication Data

US 2012/0196217 A1 Aug. 2, 2012

(51) Int. Cl.
*G03G 5/047* (2006.01)

(52) U.S. Cl.
USPC ..... 430/58.8; 430/58.05; 430/58.65; 430/58.75; 430/59.6; 430/66

(58) Field of Classification Search
USPC ..... 430/59.6, 58.05, 58.65, 58.75, 58.8, 66
See application file for complete search history.

(56) References Cited

U.S. PATENT DOCUMENTS

| | | | | |
|---|---|---|---|---|
| 4,464,450 | A | 8/1984 | Teuscher | |
| 4,587,189 | A | 5/1986 | Hor et al. | |
| 4,892,811 | A | 1/1990 | Yagihara et al. | |
| 4,921,773 | A | 5/1990 | Melnyk et al. | |
| 5,030,707 | A | 7/1991 | Wang | |
| 5,482,811 | A | 1/1996 | Keoshkerian et al. | |
| 5,521,306 | A | 5/1996 | Burt et al. | |
| 7,005,222 | B2 | 2/2006 | Horgan et al. | |
| 7,033,714 | B2 | 4/2006 | Horgan et al. | |
| 2006/0166115 | A1 * | 7/2006 | Horgan et al. | 430/58.3 |
| 2007/0298341 | A1 * | 12/2007 | Wu et al. | 430/58.8 |
| 2008/0014518 | A1 * | 1/2008 | Yanus et al. | 430/58.05 |
| 2008/0311497 | A1 * | 12/2008 | Wu et al. | 430/59.5 |
| 2009/0053636 | A1 * | 2/2009 | Lin et al. | 430/58.5 |
| 2009/0208856 | A1 * | 8/2009 | Wu et al. | 430/57.3 |
| 2011/0151365 | A1 * | 6/2011 | Wu et al. | 430/58.8 |

FOREIGN PATENT DOCUMENTS

| | | | | |
|---|---|---|---|---|
| JP | 2000-275880 | * 6/2000 | | G03G 5/07 |
| JP | 2000275880 A | * 10/2000 | | G03G 5/07 |

OTHER PUBLICATIONS

English language translation of JP 2000275880 A, Oct. 2000, Kami et al.*
English language translation of JP 2000-275880.*

* cited by examiner

*Primary Examiner* — Christopher Rodee
*Assistant Examiner* — Omar Kekia
(74) *Attorney, Agent, or Firm* — Eugene O. Palazzo

(57) ABSTRACT

A photoconductor containing an optional supporting substrate layer, a photogenerating layer, a polyalkylene glycol benzoate containing charge transport layer, and a top overcoat layer in contact with and contiguous to the charge transport layer, and which overcoat layer includes charge transport compounds and melamine resins.

5 Claims, 4 Drawing Sheets

POLYALKYLENE GLYCOL BENZOATE CONTAINING PHOTOCONDUCTORS

There is disclosed a photoconductor comprising a supporting substrate, an optional hole blocking layer, an optional adhesive layer, a photogenerating layer, a charge transport layer that includes a charge transporting compound and a polyalkylene glycol benzoate, and an overcoat layer comprising a charge transport compound and a melamine resin.

BACKGROUND

Photoconductors that are selected for imaging systems, such as xerographic imaging processes, are known. These photoconductors usually contain certain photogenerating layer pigments and charge transport layer components. A problem associated with a number of the known photoconductors is that undesirable image ghosting may result on the developed xerographic images, which ghosting causes image defects, and unwanted background deposits. This ghosting in turn may require the untimely replacement of photoconductors at significant costs.

Also known are photoconductors that have a minimum resistance or that lack resistance to abrasion from dust, charging rolls, toner, and carrier. Further, the surface layers of photoconductors are subject to scratches, which decrease their lifetime, and which in xerographic imaging systems, adversely affect the quality of the developed images. While used photoconductor components can be partially recycled, there continues to be added costs and potential environmental hazards when recycling.

Thus, there is a need for ghost resistant photoconductors with excellent or acceptable mechanical characteristics, especially in xerographic systems where biased charging rolls (BCR) are used.

Also, there is a need for photoconductors with minimal ghosting characteristics where minimal refers to a ghosting grade of from about −1 to about −3.5, from about −1 to about 0 (zero), from about −1 to about −3, from about −2.5 to about 0 (zero), from about −2.5 to about −1, or from about −1 to about −2.

There is also a need for photoconductors with acceptable low ghosting characteristics, and which photoconductors permit the rapid transport of holes in the charge transport layer present in the photoconductor.

Photoconductors with excellent cyclic characteristics and stable electrical properties, stable long term cycling, minimal charge deficient spots (CDS), and acceptable lateral charge migration (LCM) characteristics, such as excellent LCM resistance, are also desirable needs.

These and other needs are believed to be achievable with the photoconductors disclosed herein.

SUMMARY

Disclosed is a photoconductor comprising a supporting substrate, a hole blocking layer, an adhesive layer, a photogenerating layer, a charge transport layer comprising a charge transport compound, and a polyalkylene glycol benzoate, and an overcoat layer in contact with the charge transport layer, the overcoat layer comprising a charge transport compound and a melamine resin.

There is illustrated herein a photoconductor comprising a supporting substrate, a photogenerating layer, and a charge transport layer comprising a charge transport compound and a polyalkylene glycol benzoate, and a crosslinked overcoat layer in contact with the charge transport layer, the overcoat layer comprising a charge transport compound, a melamine resin, and a hydroxyl terminated fluorinated additive, a hydroxyl silicone modified polyacrylate additive, or mixtures thereof.

Also, there is illustrated herein a photoconductor comprising a photogenerating layer, a polyalkylene glycol benzoate containing charge transport layer, and an overcoat layer in contact with the charge transport layer, the overcoat layer comprising a charge transport compound and a melamine resin, and wherein the photoconductor possesses a ghosting grade of from about −2.5 to about zero.

FIGURES

There are provided the following Figures to further illustrate the photoconductors disclosed herein.

EMBODIMENTS

In embodiments of the present disclosure, there is illustrated a photoconductor comprising in sequence a supporting substrate, an optional anticurl layer, an optional hole blocking layer, an optional adhesive layer, a photogenerating layer, at least one charge transport layer comprising a charge transport component and a polyalkylene glycol benzoate, and an overcoat layer.

Exemplary and non-limiting examples of photoconductors and the characteristics thereof according to embodiments of the present disclosure are depicted in FIGS. 1, 2, 3, and 4.

Figure 1:
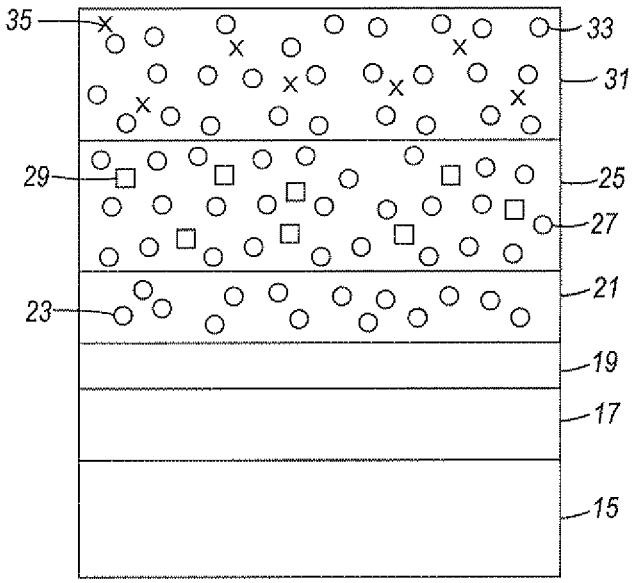
FIG. 1 illustrates an exemplary embodiment of an overcoated layered photoconductor of the present disclosure.

In FIG. 1, there is illustrated an overcoated photoconductor comprising a supporting substrate layer 15, a hole blocking layer 17, an adhesive layer 19, a photogenerating layer 21 containing photogenerating pigments 23, a charge transport layer 25 containing charge transport compounds 27, and polyalkylene glycol benzoates, such as polypropylene glycol dibenzoates 29, and an overcoat layer 31, containing charge transport compounds 33, and melamine resins 35.

Substrate

The substrate selected for the photoconductors of the present disclosure may comprise a layer of an electrically substantially nonconductive material or a layer of a conductive material. Examples of known non-conducting supporting substrate materials include polyesters, polycarbonates, polyamides, polyurethanes, and the like, and mixtures thereof.

In embodiments, when the photoconductor supporting substrate layer is not conductive, the surface may be rendered electrically conductive by depositing thereon a known electrically conductive coating like a coating of a metal oxide. The conductive coating may vary in thickness, such as from about 1 to about 50 microns, from 1 to about 35 microns, or from about 3 to about 25 microns, depending upon the optical transparency to be achieved, degree of flexibility desired, and economic factors.

An electrically conducting supporting substrate that may be selected for the photoconductors illustrated herein include metal containing polymers, titanium containing MYLAR®, metals including aluminum, nickel, steel, copper, gold, and the like, and mixtures thereof filled with an electrically conducting substance. Examples of electrically conducting substances include carbon, metallic powder, and the like, or an organic electrically conducting material.

Illustrative examples of photoconductor supporting substrates include a layer of insulating material including inorganic or organic polymeric materials, such as MYLAR® (a commercially available polymer), a MYLAR® containing titanium layer, a layer of an organic or inorganic material having a semiconductive surface layer, such as indium tin oxide or aluminum arranged thereon, or a conductive material inclusive of aluminum, chromium, nickel, brass, or the like, and mixtures thereof.

The thickness of the photoconductor supporting substrate depends on many factors, including economical considerations, electrical characteristics, adequate flexibility, availability and cost of the specific components for each layer, and the like. Thus, this layer may be of a substantial thickness, for example up to about 3,000 microns, such as from about 1,000 to about 2,000 microns, from about 500 to about 1,000 microns, or from about 300 to about 700 microns, or of a minimum thickness of from about 75 to about 100 microns. In embodiments, the thickness of this layer is from about 75 to about 300 microns or from about 100 to about 150 microns.

The substrate may be flexible, seamless, or rigid, and may have a number of many different configurations, such as, for example, a plate, a cylindrical drum, a scroll, an endless flexible belt, a drelt (a cross between a drum and a belt), and the like. In embodiments, the photoconductor substrate is in the form of a seamless flexible belt.

Anticurl Layer

In some situations, it may be desirable to coat a known anticurl layer on the back of the photoconductor substrate, particularly when the substrate is a flexible organic polymeric material. This anticurl layer is sometimes referred to as an anticurl backing layer. Suitable materials selected for the photoconductor anticurl layer include, for example, polycarbonates commercially available as MAKROLON®, polyesters, and the like. The anticurl layer can be of a thickness of from about 5 to about 40 microns, from about 10 to about 30 microns, or from about 15 to about 25 microns.

Ground Plane Layer

Positioned on the top side of the supporting substrate there can be included a ground plane such as gold, gold containing compounds, aluminum, titanium, titanium/zirconium, and other suitable known components. The thickness of the ground plane layer can be from about 10 to about 100 nanometers, from about 20 to about 50 nanometers, from about 10 to about 30 nanometers, from about 15 to about 25 nanometers, or from about 20 to about 35 nanometers.

Hole-Blocking Layer

An optional charge blocking layer or hole blocking layer may be applied to the photoconductor supporting substrate, such as an electrically conductive supporting substrate surface prior to the application of a photogenerating layer. An optional charge blocking layer or hole blocking layer, when present, is usually in contact with the ground plane layer, and also can be in contact with the supporting substrate. The hole blocking layer generally comprises any of a number of known components as illustrated herein, such as metal oxides, phenolic resins, aminosilanes, and the like, and mixtures thereof. The hole blocking layer can have a thickness of from about 0.01 to about 30 microns, from about 0.02 to about 5 microns, or from about 0.03 to about 2 microns.

Examples of aminosilanes included in the hole blocking layer can be represented by the following formula/structure

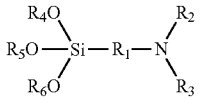

wherein $R_1$ is alkylene, straight chain or branched, containing from 1 to about 25 carbon atoms, from 1 to about 18 carbon atoms, from 1 to about 12 carbon atoms, or from 1 to about 6 carbon atoms; $R_2$ and $R_3$ are independently selected from the group consisting of at least one of a hydrogen atom, alkyl containing from 1 to about 12 carbon atoms, or from 1 to about 4 carbon atoms, aryl containing from about 6 to about 24 carbon atoms, from about 6 to about 18 carbon atoms, or from about 6 to about 12 carbon atoms, such as a phenyl group; and a poly(alkylene amino) group, such as a poly (ethylene amino) group, and where $R_4$, $R_5$ and $R_6$ are independently an alkyl group containing from 1 to about 12 carbon atoms, from 1 to about 10 carbon atoms, or from 1 to about 4 carbon atoms.

Specific examples of suitable hole blocking layer aminosilanes include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilyipropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy) silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino) ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Yet more specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

The hole blocking layer aminosilane may be treated to form a hydrolyzed silane solution before being added into the final hole blocking layer coating solution or dispersion. During hydrolysis of the aminosilanes, the hydrolyzable groups, such as the alkoxy groups, are replaced with hydroxyl groups. The pH of the hydrolyzed silane solution can be controlled to from about 4 to about 10, or from about 7 to about 8 to thereby result in photoconductor electrical stability. Control of the pH of the hydrolyzed silane solution may be affected with any suitable material, such as generally organic acids or inorganic acids. Examples of organic and inorganic acids selected for pH control include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or a dispersion onto the photoconductor supporting substrate, or on to the ground plane layer by the use of a spray coater, dip coater, extrusion coater, roller coater, wire-bar coater, slot coater, doctor blade coater, gravure coater, and the like, and dried at from about 40° C. to about 200° C. or from 75° C. to 150° C. for a suitable period of time, such as from about 1 hour to about 4 hours, from about 1 minute to about 10 hours, or from about 40 minutes to about 100 minutes in the presence of an air flow. The hole blocking layer coating can be accomplished in a manner to provide a final hole blocking layer coating thickness after drying of, for example, from about 0.01 to about 30 microns, from about 0.02 to about 5 microns, or from about 0.03 to about 2 microns.

Adhesive Layer

An adhesive layer may be included between the hole blocking layer and the photogenerating layer. Typical adhesive layer materials selected for the photoconductors illustrated herein include polyesters, polyurethanes, copolyesters, polyamides, poly(vinyl butyrals), poly(vinyl alcohols), polyacrylonitriles, and the like, and mixtures thereof. The adhesive layer thickness can be from about 0.001 to about 1 micron, from about 0.05 to about 0.5 micron, or from about 0.1 to about 0.3 micron. Optionally, the adhesive layer may contain effective suitable amounts of from about 1 to about 10 weight percent, or from 1 to about 5 weight percent of conductive and nonconductive particles, such as zinc oxide, titanium dioxide, silicon nitride, carbon black, polymers, and the like, and mixtures thereof.

Photogenerating Layer

Usually, the photogenerating layer is applied onto the supporting substrate, and a charge transport layer or plurality of charge transport layers are formed on the photogenerating layer. The charge transport layer may be situated on the photogenerating layer, the photogenerating layer may be situated on the charge transport layer, or when more than one charge transport layer is present, they can be contained on the photogenerating layer. Also, the photogenerating layer may be applied to layers that are situated between the supporting substrate and the charge transport layer.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, such as bis(benzimidazo) perylene, titanyl phthalocyanines, and the like, and mixtures thereof.

Examples of photogenerating pigments are vanadyl phthalocyanines, Type V hydroxygallium phthalocyanines, high sensitivity titanyl phthalocyanines, quinacridones, polycyclic pigments such as dibromo anthanthrone pigments, perinone diamines, polynuclear aromatic quinones, azo pigments including bis-, tris- and tetrakis-azos, and the like; inorganic components such as selenium, selenium alloys, and trigonal selenium; and pigments of crystalline selenium and its alloys. The photogenerating pigment can be dispersed in a resin binder similar to the resin binders selected for the charge transport layer, or alternatively no resin binder need be present. For example, the photogenerating pigments can be present in an optional resinous binder composition in various amounts inclusive of up to 99.5 percent by weight. Generally, from about 5 to about 95 percent by volume of the photogenerating pigment is dispersed in about 95 to about 5 percent by volume of a resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition.

Examples of polymeric binder materials that can be selected as the matrix for the photogenerating layer pigments include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like, inclusive of block, random, or alternating copolymers thereof.

It is often desirable to select a coating solvent for the photogenerating layer mixture, and which solvent does not substantially disturb or adversely affect the previously coated layers of the photoconductor. Examples of coating solvents used for the photogenerating layer coating mixture include ketones, alcohols, aromatic hydrocarbons, halogenated aliphatic hydrocarbons, ethers, amines, amides, esters, and the like, and mixtures thereof. Specific solvent examples selected for the photogenerating mixture are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer can be of a thickness of from about 0.01 to about 10 microns, from about 0.05 to about 10 microns, from about 0.2 to about 2 microns, or from about 0.25 to about 1 micron.

Charge Transport Layer

The charge transport layer or layers, and more specifically, in embodiments, a first charge transport layer in contact with the photogenerating layer, and over the first charge transport layer a top or second charge transport overcoating layer, may comprise charge transporting compounds or molecules dissolved or molecularly dispersed in a film forming electrically inert polymer such as a polycarbonate. In embodiments, "dissolved" refers, for example, to forming a solution in which the charge transport molecules are dissolved in a polymer to form a homogeneous phase; and "molecularly dispersed" refers, for example, to charge transporting molecules or compounds dispersed on a molecular scale in a polymer.

In embodiments, charge transport refers, for example, to charge transporting molecules that allow the free charge generated in the photogenerating layer to be transported across the charge transport layer. The charge transport layer is usually substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge present on the surface of the photoconductor.

A number of charge transport compounds can be included in the charge transport layer or in at least one charge transport layer. Examples of charge transport components or compounds are aryl amines selected from the group consisting of those represented by the following formulas/structures

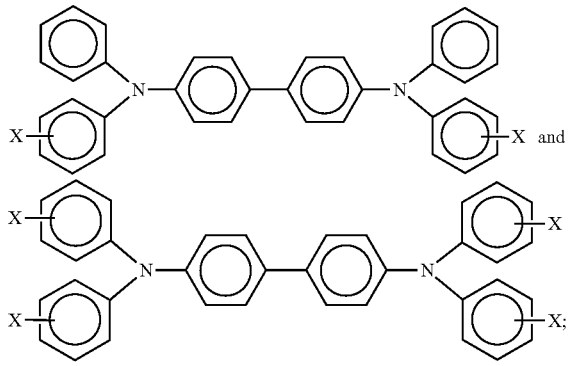

wherein X is a suitable hydrocarbon like alkyl, alkoxy, aryl, and derivatives thereof, a halogen, or mixtures of a suitable hydrocarbon and a halogen, and charge transport compounds as represented by the following formula/structure

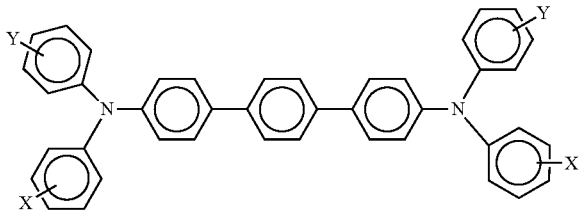

wherein X and Y are independently alkyl, alkoxy, aryl, a halogen, or mixtures thereof.

Alkyl and alkoxy for the photoconductor charge transport layer compounds illustrated herein contain, for example, from about 1 to about 25 carbon atoms, from about 1 to about 12 carbon atoms, or from about 1 to about 6 carbon atoms, such as methyl, ethyl, propyl, butyl, pentyl, hexyl, heptyl, octyl, nonyl, decyl, undecyl, dodecyl, pentadecyl, and the like, and the corresponding alkoxides. Aryl substituents for the charge transport layer compounds can contain from 6 to about 36, from 6 to about 24, from 6 to about 18, or from 6 to about 12 carbon atoms, such as phenyl, naphthyl, anthryl, and the like. Halogen substituents for the charge transport layer compounds include chloride, bromide, iodide, and fluoride. Substituted alkyls, alkoxys, and aryls can also be selected for the charge transport layer compounds.

Examples of specific aryl amines present in at least one photoconductor charge transport layer, in an amount of from about 40 to about 80, from about 50 to about 75, or from about 40 to about 60 weight percent, include N,N'-diphenyl-N,N'-bis(alkylphenyl)-1,1-biphenyl-4,4'-diamine wherein alkyl is selected from the group consisting of methyl, ethyl, propyl, butyl, hexyl, heptyl, octyl, nonyl, decyl, undecyl, dodecyl, pentadecyl, and the like; N,N'-diphenyl-N,N-bis(halophenyl)-1,1'-biphenyl-4,4'-diamine wherein the halo substituent is chloro; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like; hydrazones such as N-phenyl-N-methyl-3-(9-ethyl)carbazyl hydrazone and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like.

Examples of charge transport layer binders present in various amounts, and where the total weight percent of the binder and the charge transport compound equals about 100 weight percent include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), PCZ-400 poly(4,4'-dihydroxy-diphenyl-1-1-cyclohexane), and the like. In embodiments, electrically inactive binders that can be selected for the charge transport layer or charge transport layers are comprised of polycarbonate resins with a weight average molecular weight $M_w$ of from about 20,000 to about 100,000, or of from about 50,000 to about 100,000.

The photoconductors disclosed herein also include in the charge transport layer or layers a polyalkylene glycol benzoate where alkylene contains from 1 to about 14 carbon atoms, from 1 to about 12 carbon atoms, from 1 to about 10 carbon atoms, from 1 to about 8 carbon atoms, from about 2 to about 10 carbon atoms, or from about 2 to about 6 carbon atoms.

Examples of polyalkylene glycol benzoates that may be selected for the charge transport layer or charge transport layers are represented by the following formulas/structures

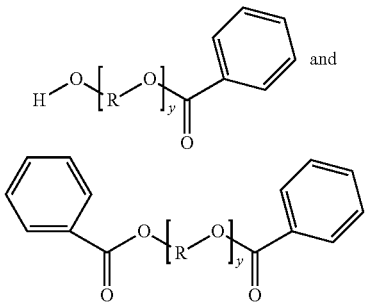

wherein R is an alkylene that contains from 1 to about 12 carbon atoms, from 2 to about 10 carbon atoms, from about 2 to about 6 carbon atoms, or from about 2 to about 4 carbon atoms, such as methylene, ethylene, propylene, butylene, pentylene, hexylene, heptylene, octylene, nonylene, decylene, and the like; and y represents the number of repeating units of, for example, from about 1 to about 50, from about 1 to about 35, from about 1 to about 20, from 1 to about 10, or from about 1 to about 6.

Polyalkylene glycol benzoates selected for the charge transport layer or charge transport layers are polypropylene glycol dibenzoates represented by the following formula/structure

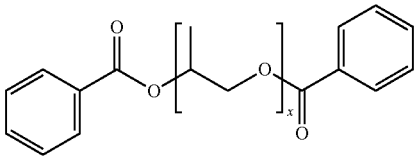

where it is known that the dangling bond with no substituent is an alkyl group, such as a methyl group, and where x represents the number of repeating segments such as from about 1 to about 10, or from about 1 to about 4. Examples of polypropylene glycol dibenzoates are UNIPLEX® 400 (x=2); UNIPLEX® 988 (x=3); and UNIPLEX® 284 (x=1), all available from Unitex Chemical Corporation.

Specific examples of polyalkylene glycol benzoates that can be present in the charge transport layer or charge transport layers are a polypropylene glycol benzoate and a polypropylene glycol dibenzoate, a polyethylene glycol benzoate and a polyethylene glycol dibenzoate, a polybutylene glycol benzoate and a polybutylene glycol dibenzoate, a polypentylene glycol benzoate and a polypentylene glycol dibenzoate, a polyhexylene glycol benzoate and a polyhexylene glycol dibenzoate, a polyheptylene glycol benzoate and a polyheptylene glycol dibenzoate, a polyoctylene glycol benzoate and a polyoctylene glycol dibenzoate, a polynonylene glycol benzoate and a polynonylene glycol dibenzoate, a polydecylene glycol benzoate and a polydecylene glycol dibenzoate, the corresponding copolymers thereof, and mixtures thereof.

The polyalkylene glycol benzoates and the corresponding dibenzoates possess, for example, a number average molecular weight ($M_n$) of from about 150 to about 10,000, from about 200 to about 1,000, or from about 100 to about 1,000. The polyalkylene glycol benzoates and the corresponding dibenzoates possess, for example, a weight average molecular weight ($M_w$) of from about 200 to about 20,000, from about 300 to about 2,000, about 200 to about 2,000, or from about 100 to about 1,000, where $M_w$ and $M_n$ were determined by Gel Permeation Chromatography (GPC).

The polyalkylene glycol benzoates can be present in the charge transport layer in any effective and desired amount. For example, the polyalkylene glycol benzoates can be present in at least one charge transport layer in an amount of from about 0.01 to about 10 weight percent, from about 0.1 to about 10, from about 0.1 to about 5, from about 0.5 to about 5 weight percent, or from about 0.5 to about 3 weight percent based on the weight percent of the benzoate, and the other components present in the charge transport layer or charge transport layers. At least one of the charge transport layers refers to from 1 to about 5 layers, from 1 to about 3 layers, 2 layers, or one layer.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited layer coating or layer coatings may be affected by any suitable conventional technique such as oven drying, infrared radiation drying, air drying, and the like.

The thickness of the charge transport layer or charge transport layers, in embodiments, is from about 5 or about 10 to about 70 microns, from about 20 to about 65, from about 15 to about 50, or from about 10 to about 40 microns, but thicknesses outside this range may, in embodiments, also be selected. The charge transport layer should be an insulator to the extent that an electrostatic charge placed on the charge transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances about 400:1.

Examples of components or materials optionally incorporated into at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

Overcoat Layer

The overcoat layer in contact with the charge transport layer comprises a charge transport component or a charge transport compound, such as those illustrated herein, and a melamine resin. One exemplary charge transport compound selected for the overcoat layer is N,N'-diphenyl-N,N-diphenyl-N,N'-bis(3-hydroxyphenyl)-[1,1'-biphenyl]-4,4'-diamine (DHTBD). The overcoat layer can be prepared by combining in solution a melamine resin, an acid catalyst, and the charge transport component.

In various embodiments, the melamine resin selected for the photoconductor overcoat layer can be represented by the following formulas/structures

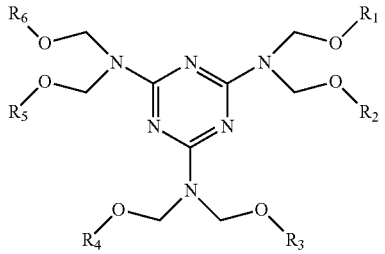

wherein $R_1$, $R_2$, $R_3$, $R_4$, $R_5$ and $R_6$ each independently represents at least one of a hydrogen atom, and alkyl with, for example, from 1 to about 12 carbon atoms, from 1 to about 8 carbon atoms, and more specifically, from 1 to about 4 carbon atoms, examples of specific alkyl substituents being illustrated herein such as methyl, ethyl, propyl, butyl, pentyl, hexyl, heptyl, octyl, nonyl, decyl, undecyl, dodecyl, pentadecyl, and the like.

Examples of melamine resins selected for the photoconductor overcoat layer include highly methylated/butylated melamine formaldehyde resins, such as those commercially available from Cytec Industries, as CYMEL® 303, 104, MM-100, and the like. These melamine formaldehyde resins, which are water-soluble, dispersible or nondispersible, exhibit a high, such as about 75 to about 95 percent, from about 80 to about 95, from about 75 to about 90, or from about 85 to about 90, percent of alkylation.

The methoxymethylated melamine resin CYMEL® 303 (available from Cytec industries as $(CH_3OCH_2)_6N_3C_3N_3$) is represented by the following formula/structure

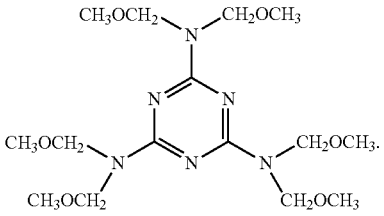

Specific examples of melamine resins present in the overcoat layer include highly (for example, from about 75 to about 95 percent, from 80 to about 95, from about 75 to about 90, or from about 85 to about 90 alkylation percentage for the alkylated/alkoxylated), partially (such as from about 40 to about 65 percent of alkylated/alkoxylated), or mixed alkylated/alkoxylated resins; methylated, n-butylated or isobutylated resins; highly methylated melamine resins such as CYMEL® 350, 9370; methylated imino melamine resins (partially methylolated and highly alkylated) such as CYMEL® 323, 327; partially methylated melamine resins (highly methylolated and partially methylated) such as CYMEL® 373, 370; high solids mixed ether melamine resins such as CYMEL® 1130, 324; n-butylated melamine resins such as CYMEL® 1151, 615; n-butylated high imino melamine resins such as CYMEL® 1158; and iso-butylated melamine resins such as CYMEL® 255-10. CYMEL® melamine resins are commercially available from CYTEC Industries, Inc. More specifically, the melamine resin may be selected from the group consisting of methylated melamine resins, methoxymethylated melamine resins, ethoxymethylated melamine resins, propoxymethylated melamine resins, butoxymethylated melamine resins, hexamethylol melamine resins, alkoxyalkylated melamine resins such as methoxymethylated melamine resin, ethoxymethylated melamine resin, propoxymethylated melamine resin, butoxymethylated melamine resin, and mixtures thereof.

The melamine resin, which can function as a crosslinking agent, is present in the photoconductor overcoat layer mixture in an amount of from about 20 to about 80 weight percent, from about 30 to about 70 weight percent, or from about 40 to about 60 weight percent based on the weight percent of the overcoat layer components of the melamine resin and the charge transport compound. The ratio of charge transport compound to the melamine resin can be from about 20/80 to about 80/20, from about 30/70 to about 70/30, from about 40/60 to about 60/40, or about 50/50. While not being desired to be limited by theory, it is believed that the crosslinking percentage of the overcoating layer components is from about 77 to about 99 percent, from about 80 to about 95 percent, or from about 70 to about 90 percent as determined by known methods, such as determined with Fourier Transform Infrared Spectroscopy (FTIR).

In embodiments, the charge transport component or compound selected for the overcoat layer is a cross linkable alcohol soluble compound represented by

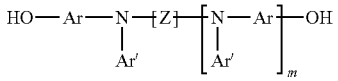

wherein m represents the number of segments, and is, for example, zero or 1; Z is selected from the group consisting of at least one of

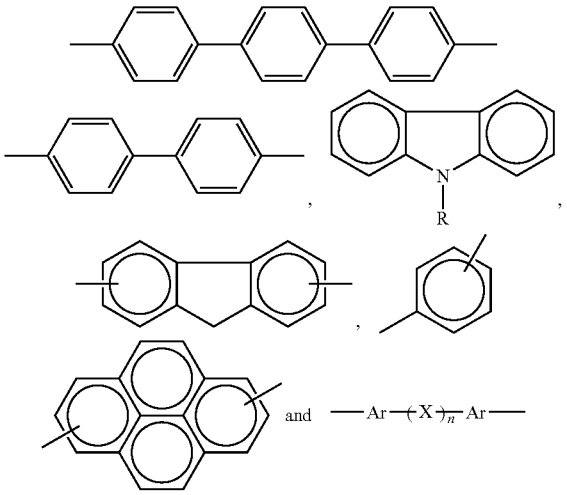

wherein n represents the number of X substituents, such as 0 or 1; Ar is selected from the group consisting of at least one of

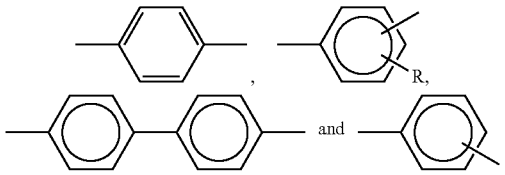

where R is selected from the group consisting of at least one of alkyl like methyl, ethyl, propyl, butyl, pentyl, and the like; Ar' is selected from the group consisting of at least one of

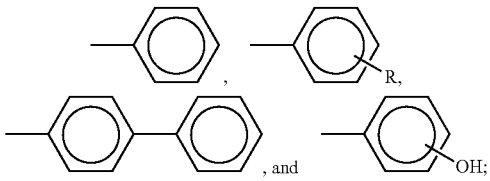

and X is selected from the group consisting of at least one of

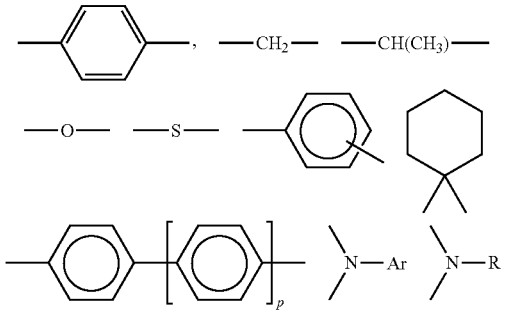

wherein p represents the number of segments, and is, for example, zero, 1, or 2; R is alkyl, and Ar is selected from the group consisting of at least one of the substituents represented by the following formulas/structures

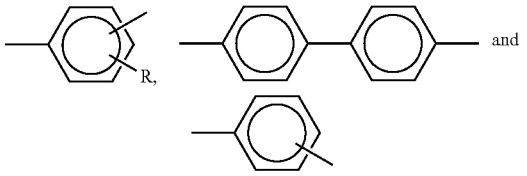

wherein R is alkyl.

Examples of charge transport compounds present in the overcoat layer are hydroxyl aryl amines represented by

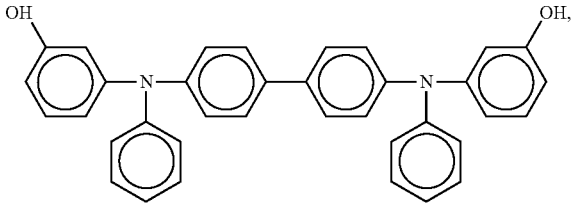

and dihydroxyaryl terphenylamines represented by

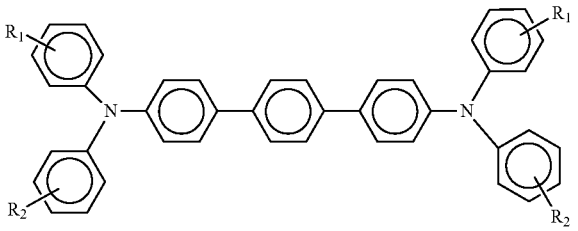

wherein each $R_1$ and $R_2$ is independently selected from the group consisting of at least one of a hydrogen atom, a hydroxy group, a group represented by $—C_nH_{2n+1}$ where n is from 1 to about 12 or from 1 to about 6, aralkyl, and aryl groups with from about 6 to about 36 carbon atoms, from about 6 to about 24 carbon atoms, from 6 to about 18 carbon atoms, or from 6 to about 12 carbon atoms.

The charge transport compound is present in the overcoat layer in the amounts illustrated herein, and more specifically, in an amount of from about 80 to about 20 weight percent, from about 70 to about 30 weight percent, or from about 60 to about 40 weight percent of the overcoat layer components.

A crosslinking reaction of the melamine resin and the charge transport material can be catalyzed with a strong acid catalyst. Examples of strong acid catalysts include p-toluene sulfonic acid, commercially available acid catalysts available from CYCAT® such as CYCAT® 600, CYCAT® 4040, and the like. In embodiments, the catalyst is added to the overcoat layer mixture components in an amount of from about 0.1 to about 5 weight percent, from about 0.3 to about 3 weight percent, or from about 0.4 to about 1 weight percent.

The overcoat layer in embodiments of the present disclosure can be prepared by coating a solution of a solvent like an alcohol, a melamine resin, an acid catalyst, and a charge transport compound, heating to a temperature of from about 120° C. to about 200° C. for a period of from about 30 minutes to about 120 minutes, and allowing the resulting mixture to cool to room temperature (about 25° C.). Examples of acid catalysts selected for the crosslinking reaction include p-toluene sulfonic acid and where the ratio of the melamine resin to the charge transport compound reactants is from about 30/70 to about 70/30 (melamine resin/charge transport weight ratio), resulting in a cross-linked structure of the charge transport compound and the melamine resin. The estimated crosslinking percentage resulting is from about 70 to about 99 percent, from about 80 to about 95 percent, or from about 75 to about 85 percent, which crosslinking can be determined by Fourier transform infrared spectroscopy (FTIR).

Additionally, there may be included in the overcoat layer low surface energy components, such as hydroxyl terminated fluorinated additives, hydroxyl silicone modified polyacrylates, and mixtures thereof. Examples of the low surface energy components, present in various effective amounts, such as from about 0.1 to about 10 weight percent, from about 0.5 to about 5 weight percent, or from about 1 to about 3 weight percent, are hydroxyl derivatives of perfluoropolyoxyalkanes such as FLUOROLINK® D (M.W. about 1,000 and fluorine content about 62 percent), FLUOROLINK® D10-H (M.W. about 700 and fluorine content about 61 percent), and FLUOROLINK® D10 (M.W. about 500 and fluorine content about 60 percent) (functional group $—CH_2OH$); FLUOROLINK® E (M.W. about 1,000 and fluorine content about 58 percent) and FLUOROLINK® E10 (M.W. about 500 and fluorine content about 56 percent) (functional group $—CH_2(OCH_2CH_2)_nOH$); FLUOROLINK® T (M.W. about 550 and fluorine content about 58 percent) and FLUOROLINK® T10 (M.W. about 330 and fluorine content about 55 percent) (functional group $—CH_2OCH_2CH(OH)CH_2OH$); and hydroxyl derivatives of perfluoroalkanes ($R_fCH_2CH_2OH$, wherein $R_f=F(CF_2CF_2)_n$) such as ZONYL® BA (M.W. about 460 and fluorine content about 71 percent), ZONYL® BA-L (M.W. about 440 and fluorine content about 70 percent), ZONYL® BA-LD (M.W. about 420 and fluorine content about 70 percent), and ZONYL® BA-N (M.W. about 530 and fluorine content about 71 percent); carboxylic acid derivatives of fluoropolyethers such as FLUOROLINK® C (M.W. about 1,000 and fluorine content about 61 percent), carboxylic ester derivatives of fluoropolyethers such as FLUOROLINK® L (M.W. about 1,000 and fluorine content about 60 percent), FLUOROLINK® L10 (M.W. about 500 and fluorine content about 58 percent), carboxylic ester derivatives of perfluoroalkanes ($R_fCH_2CH_2O(C=O)R$, wherein $R_f=F(CF_2CF_2)_n$ and R is alkyl) such as ZONYL® TA-N (fluoroalkyl acrylate, $R=CH_2=CH—$, M.W. about 570 and fluorine content about 64 percent), ZONYL® TM (fluoroalkyl methacrylate, $R=CH_2=C(CH_3)—$, M.W. about 530 and fluorine content about 60 percent), ZONYL® FTS (fluoroalkyl stearate, $R=C_{17}H_{35}—$, M.W. about 700 and fluorine content about 47 percent), ZONYL® TBC (fluoroalkyl citrate, M.W. about 1,560 and fluorine content about 63 percent), sulfonic acid derivatives of perfluoroalkanes ($R_fCH_2CH_2SO_3H$, wherein $R_f$=$F(CF_2CF_2)_n$) such as ZONY®L TBS (M.W. about 530 and fluorine content about 62 percent); ethoxysilane derivatives of fluoropolyethers such as FLUOROLINK® S10 (M.W. about 1,750 to 1,950); phosphate derivatives of fluoropolyethers such as FLUOROLINK® F10 (M.W. about 2,400 to 3,100); hydroxyl derivatives of silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. FLUOROLINK® is a trademark of Ausimont, Inc., ZONYL® is a trademark of E.I. DuPont, and BYK-SILCLEAN® is a trademark of BYK Silclean.

Any suitable solvent, such as a primary, secondary, or tertiary alcohol solvent can be employed for the deposition of the film forming overcoat layer. Typical alcohol solvents include, but are not limited to, tert-butanol, sec-butanol, n-butanol, 2-propanol, 1-methoxy-2-propanol, and the like, and mixtures thereof. There may also be selected as deposition solvents for the forming of the overcoat layer tetrahydrofuran, monochlorobenzene, methylene chloride, toluene, xylene and mixtures thereof.

The thickness of the overcoat layer as measured with a Permascope is from about 1 to about 20 microns, from about 1 to about 15 microns, from about 1 to about 10 microns, or from about 1 to about 5 microns. Typical application techniques for applying the overcoat layer over the outermost charge transport layer can include spraying, dip coating, roll coating, wire wound rod coating, extrusion coating, flow coating, and the like. Drying of the deposited overcoat layer can be effected by any suitable conventional technique such as oven drying, infrared radiation drying, air drying, and the like.

Also included within the scope of the present disclosure are methods of imaging and printing with the photoconductors illustrated herein. These methods generally involve the formation of an electrostatic latent image on the imaging member, followed by developing the image with a toner composition comprised, for example, of thermoplastic resin, colorant, such as pigment, charge additive, and surface additive, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductors disclosed herein can be selected for the Xerox Corporation iGEN® machines that generate with some versions over 100 copies per minute. Processes of imaging, especially xerographic imaging and printing, including digital and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying, and printing processes inclusive of digital xerographic processes.

The thicknesses of each of the photoconductor layers illustrated herein were determined by known analytical methods, and more specifically, by the use of a Permascope. The molecular weights of the components and compounds illustrated herein were determined by Gel Permeation Chromatography (GPC).

The following Examples are being submitted to illustrate embodiments of the present disclosure. These Examples are intended to be illustrative only, and are not intended to limit the scope of the present disclosure. Also, parts and percentages are by weight unless otherwise indicated. The thicknesses of each layer were measured by a Permascope. The molecular weights recited were determined by Gel Permeation Chromatography (GPC). Comparative Examples and data are also provided.

Comparative Example 1

Zirconium acetylacetonate tributoxide (35.5 parts), γ-aminopropyl triethoxysilane (4.8 parts), and polyvinyl butyral) BM-S (2.5 parts) were dissolved in n-butanol (52.2 parts). The resulting undercoat layer solution was then coated by a dip coater on a 30 millimeter thick aluminum drum substrate. The coating solution layer was preheated at 59° C. for 13 minutes, humidified at 58° C. (dew point=54° C.) for 17 minutes, and dried at 135° C. for 8 minutes. The thickness of the resulting undercoat layer was approximately 1.3 microns.

A photogenerating layer of a thickness of about 0.2 micron comprising hydroxygallium phthalocyanine Type V was deposited on the above hole blocking layer or undercoat layer at a thickness of about 1.3 microns. The photogenerating layer coating dispersion was prepared as follows. Three grams of the hydroxygallium phthalocyanine Type V pigment were mixed with 2 grams of a polymeric binder of a carboxyl-modified vinyl copolymer, VMCH, available from Dow Chemical Company, and 45 grams of n-butyl acetate. The resulting mixture was milled in an Attritor mill with about 200 grams of 1 millimeter Hi-Bea borosilicate glass beads for about 3 hours. The dispersion obtained was filtered through a 20 micron Nylon cloth filter, and the solid content of the dispersion was diluted to about 6 weight percent.

Subsequently, a 20 micron thick charge transport layer was coated on top of the photogenerating layer from a solution prepared from mixing N,N'-diphenyl-N,N-bis(3-methylphenyl)-1,1'-biphenyl-4,4'-diamine (5 grams) and a film forming polymer binder PCZ-400 (poly(4,4'-dihydroxy-diphenyl-1-1-cyclohexane), weight average molecular weight, $M_w$ of 40,000) obtained from Mitsubishi Gas Chemical Company, Ltd. (7.5 grams) in a solvent mixture of 30 grams of tetrahydrofuran (THF) and 10 grams of monochlorobenzene (MCB). The charge transport layer was dried at about 120° C. for about 20 minutes.

An overcoat layer solution was then applied to the above charge transport layer, which solution was formed by mixing and heating 8.3 grams of the melamine resin CYMEL® 303 (a methylated/butylated melamine-formaldehyde resin obtained from Cytec Industries Inc.), 9.7 grams of the charge transport compound N,N'-diphenyl-N,N'-bis(3-hydroxyphenyl)-[1,1'-biphenyl]-4,4'-diamine, 0.72 gram of BYK-SILCLEAN® 3700 (a low surface energy hydroxylated silicone modified polyacrylate obtained from BYK-Chemie USA), and 0.9 gram of NACURE® XP357 (a blocked acid catalyst obtained from King Industries) in 72 grams of DOWANOL® PM (1-methoxy-2-propanol obtained from the Dow Chemical Company). The resultant overcoat layer was dried in a forced air oven for 40 minutes at 155° C. to yield a highly, about 95 percent, crosslinked, 4.5 micron thick overcoat layer, and which overcoat layer was substantially insoluble in methanol or ethanol.

The ratio of PCZ-400 to N,N-diphenyl-N,N-bis(3-methylphenyl)-1,1'-biphenyl-4,4'-diamine in the charge transport layer was 60/40, and the ratio of N,N'-diphenyl-N,N'-bis(3-hydroxyphenyl)-[1,1'-biphenyl]-4,4'-diamine to the melamine resin/acid catalyst/low surface energy component in the overcoat layer was 45.2/52.8/1/1.

Example I

A photoconductor was prepared by repeating the process of Comparative Example 1 except that 1 weight percent of the polypropylene glycol dibenzoate UNIPLEX® 400 as obtained from Unitex Chemical Inc. (weight average molecular weight of 400) as represented by the following formula/structure

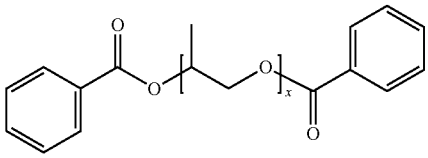

where x is the number 2, was added to the 20 micron thick charge transport layer.

Example II

Two photoconductors were prepared by repeating the process of Example I except that there was selected in place of the UNIPLEX® 400, UNIPLEX® 988, where x is the number 3, and UNIPLEX® 284 where x is the number 1.

Electrical Property Testing

The above prepared photoconductors of Comparative Example 1 and Example I were tested in a scanner set to obtain photoinduced discharge cycles, sequenced at one charge-erase cycle, followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The photoconductors were tested at surface potentials of −700 volts with the exposure light intensity incrementally increased by means of a data acquisition system where the current to the light emitting diode was controlled to obtain different exposure levels. The exposure light source was a 780 nanometer light emitting diode. The known xerographic simulation process was completed in an environmentally controlled light tight chamber at ambient conditions (40 percent relative humidity and 22° C.). The results are summarized in FIG. 2.

Figure 2:
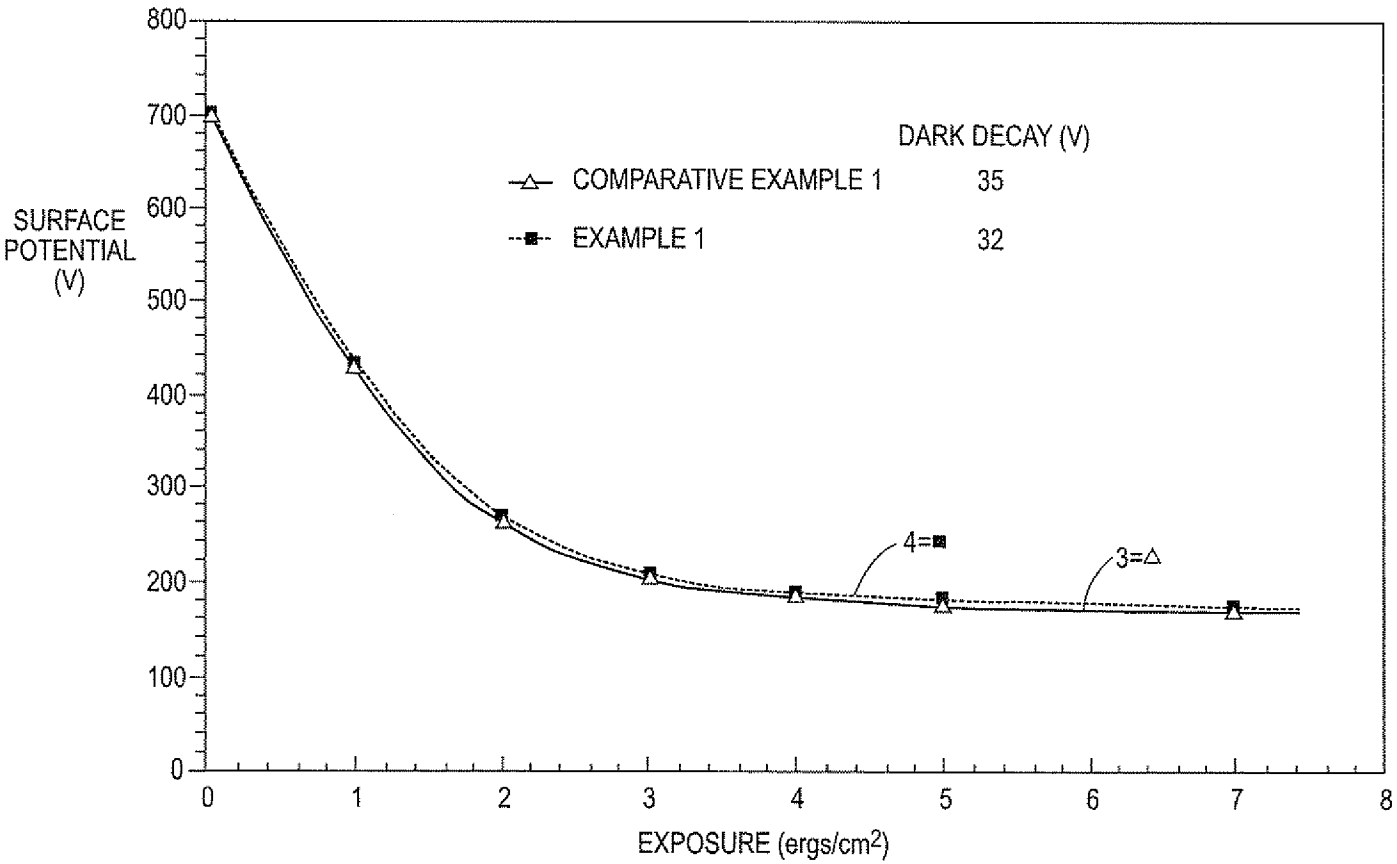
FIG. 2 illustrates a graph of photoconductor surface potentials in volts (V) versus the exposure to a LED light source in ergs/cm$^2$.

In FIG. 2, after LED light exposure and subsequent to the scanning at 120 revolutions per minute (rpm) at 50 milliseconds (ms), there is illustrated a graph comparison of the surface potentials between the overcoated photoconductor of Comparative Example 1, line 3, versus the Example I, line 4, overcoated photoconductor of the present disclosure. This graph illustrates the surface potential in volts from 0 to 800 versus the exposure in ergs/cm$^2$ of from 0 to 8. The dark decay of the Comparative Example 1 photoconductor was 35V (volts), and the dark decay of the Example I overcoated photoconductor was 32V (volts). The graph illustrates that the disclosed photoconductor of Example I exhibited a somewhat higher transport of the charge transport compounds in the charge transport layer versus the Comparative Example 1 photoconductor.

Ghosting Measurements

Ghosting refers, for example, to when a photoconductor is selectively exposed to positive charges in a number of xerographic print engines, and where some of the positive charges enter the photoconductor and manifest themselves as a latent image in the subsequent printing cycles. This print defect can cause a change in the lightness of the half tones, and is commonly referred to as a "ghost" that is generated in the previous printing cycle. An example of a source of the positive charges is the stream of positive ions emitted from the transfer corotron. Because the paper sheets are situated between the transfer corotron and the photoconductor, the photoconductor is shielded from the positive ions by the paper sheets. In the areas between the paper sheets, the photoconductor is fully exposed, thus in this paper free zone the positive charges may enter the photoconductor. As a result, these charges cause a print defect or ghost in a half tone print if one switches to a larger paper format that covers the previous paper print free zone.

The Comparative Example 1 and the Example T photoconductors were acclimated at room temperature for 24 hours before testing in A zone (80° F. and 80 percent humidity) and in J zone (70° F. and 10 percent humidity) for ghosting. Print testing was accomplished in the Xerox Corporation WorkCentre™ Pro C3545 using the K (black toner) station at t of 500 print counts (t equal to 500 is the 500$^{th}$ print), and the CMY stations of the color WorkCentre™ Pro C3545, which operated from t of 0 to t of 500 print counts.

The above generated xerographic prints for determining ghosting characteristics includes an X symbol or letter on a half toned image. When X is invisible, the ghost level is assigned Grade 0; when X is barely visible, the ghost level is assigned Grade 1; Grade 2 to Grade 5 refers to the level of visibility of X with Grade 5 meaning a dark and visible X. Ghosting levels were visually measured against an empirical scale, the smaller the ghosting grade (absolute value), the better the print quality. A negative ghosting grade number, such as −1 or 0 in A zone or J zone, for Example I translates into improved and excellent ghosting characteristics as compared to Comparative Example 1. The ghosting results are summarized in Table 1.

TABLE 1

| Photoconductor | A Zone Ghosting | J Zone Ghosting |
|---|---|---|
| | T = 500 prints | T = 500 prints |
| Comparative Example 1 | Grade −2.5 | Grade −1 |
| Example I | Grade −1 | Grade 0 |

Cyclic Stability Testing

The above-prepared photoconductor of Example I was tested for cyclic stability by using an in-house high-speed Hyper Mode Test (HMT). The HMT fixture rotated the drum photoconductor at 150 rpm under a Scoroton set to −700 volts, then the drum was exposed to a LED erase lamp. Two voltage probes were positioned 90 degrees apart to measure $V_{high}$ ($V_H$) and $V_{residual}$ ($V_L$) with nonstop 250,000 cycles of charge/discharge/erase cycling. The ozone that was produced during cycling was evacuated by an air pump and an ozone filter to simulate a more realistic machine printing environment. The HMT cycling results are shown in Table 2 for A zone and in Table 3 for J zone, see the graphs in FIGS. 3 and 4, which demonstrate that both $V_H$ and $V_L$ of the disclosed photoconductor of Example I possessed excellent cyclic stability.

TABLE 2

| A Zone HMT Cycles | | 100 | 50,000 | 100,000 | 200,000 |
|---|---|---|---|---|---|
| Example I | $V_H$ (V) | 713 | 691 | 687 | 684 |
| | $V_L$ (V) | 118 | 147 | 163 | 176 |

TABLE 3

| J Zone HMT Cycles | | 100 | 50,000 | 100,000 | 200,000 |
|---|---|---|---|---|---|
| Example I | $V_H$ (V) | 704 | 686 | 681 | 674 |
| | $V_L$ (V) | 205 | 211 | 211 | 214 |

Figure 3:
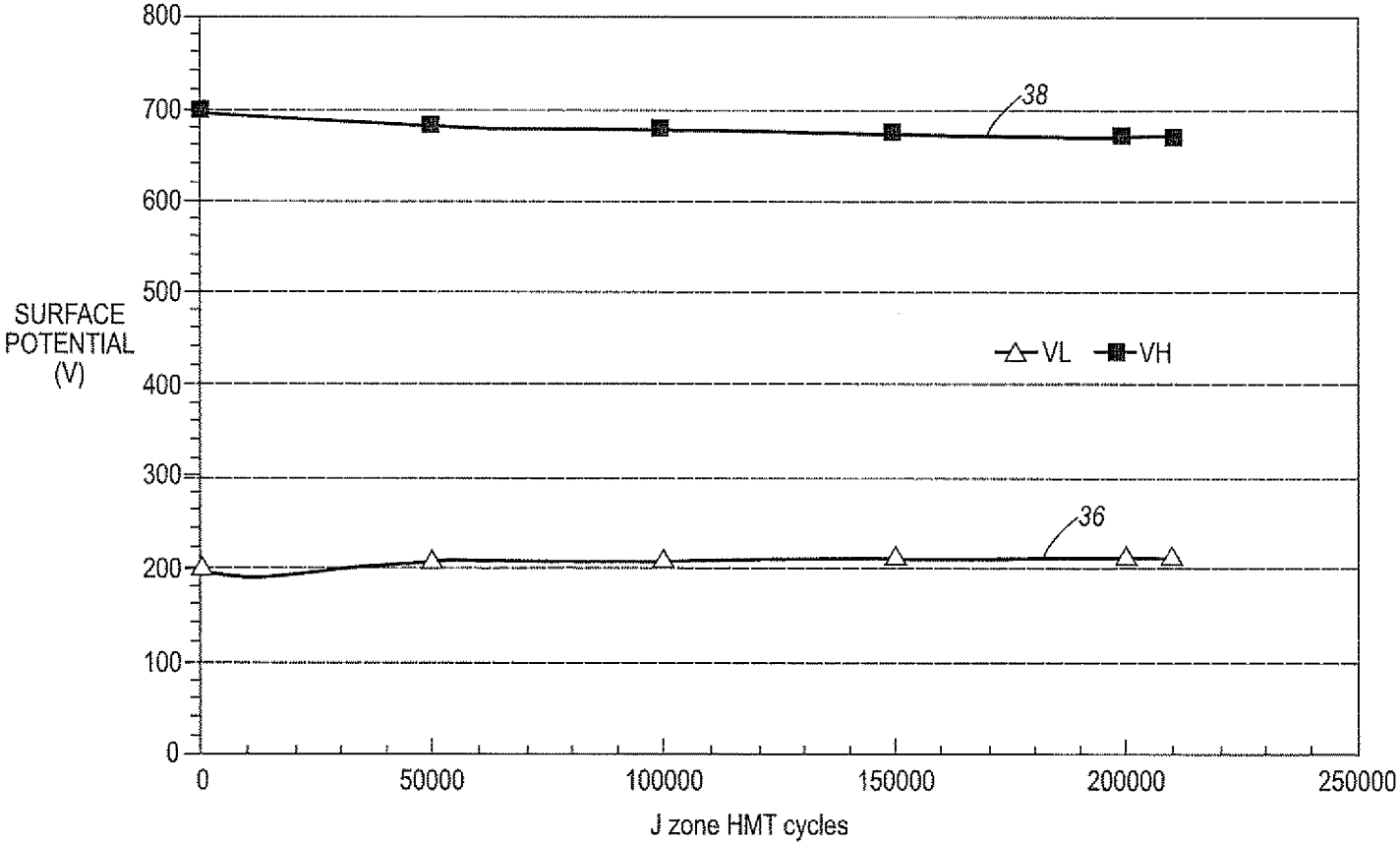
FIG. 3 illustrates a graph of photoconductor surface potentials in volts (V) versus the A zone HMT cycles where HMT refers to a known high speed Hyper Mode Test used to determine the xerographic cyclic stability of the photoconductors illustrated herein.

In FIG. 3, there is illustrated a graph of the surface potentials of the overcoated photoconductor of Example I where line 36 designates $V_L$, and line 38 designates $V_H$. This graph illustrates the surface potentials in volts of from 0 to 800 versus A zone (80 percent relative humidity and 80° F.) HMT cycles (photoconductor cyclic stability) of from 0 to 250,000, using a known in-house high-speed Hyper Mode Test (HMT). The HMT fixture rotated the drum photoconductor of Example I at 150 rpm under a Scoroton set to −700 volts. The drum photoconductor was then exposed to a LED erase lamp. Two voltage probes were positioned 90 degrees apart to measure $V_{high}$ ($V_H$) and $V_{residual}$ ($V_L$) starting at zero cycles up to a continuous 250,000 xerographic simulated cycles of charge/discharge/erase. The ozone that was produced during cycling was evacuated by an air pump and an ozone filter to simulate realistic xerographic machine printing environments.

Figure 4:
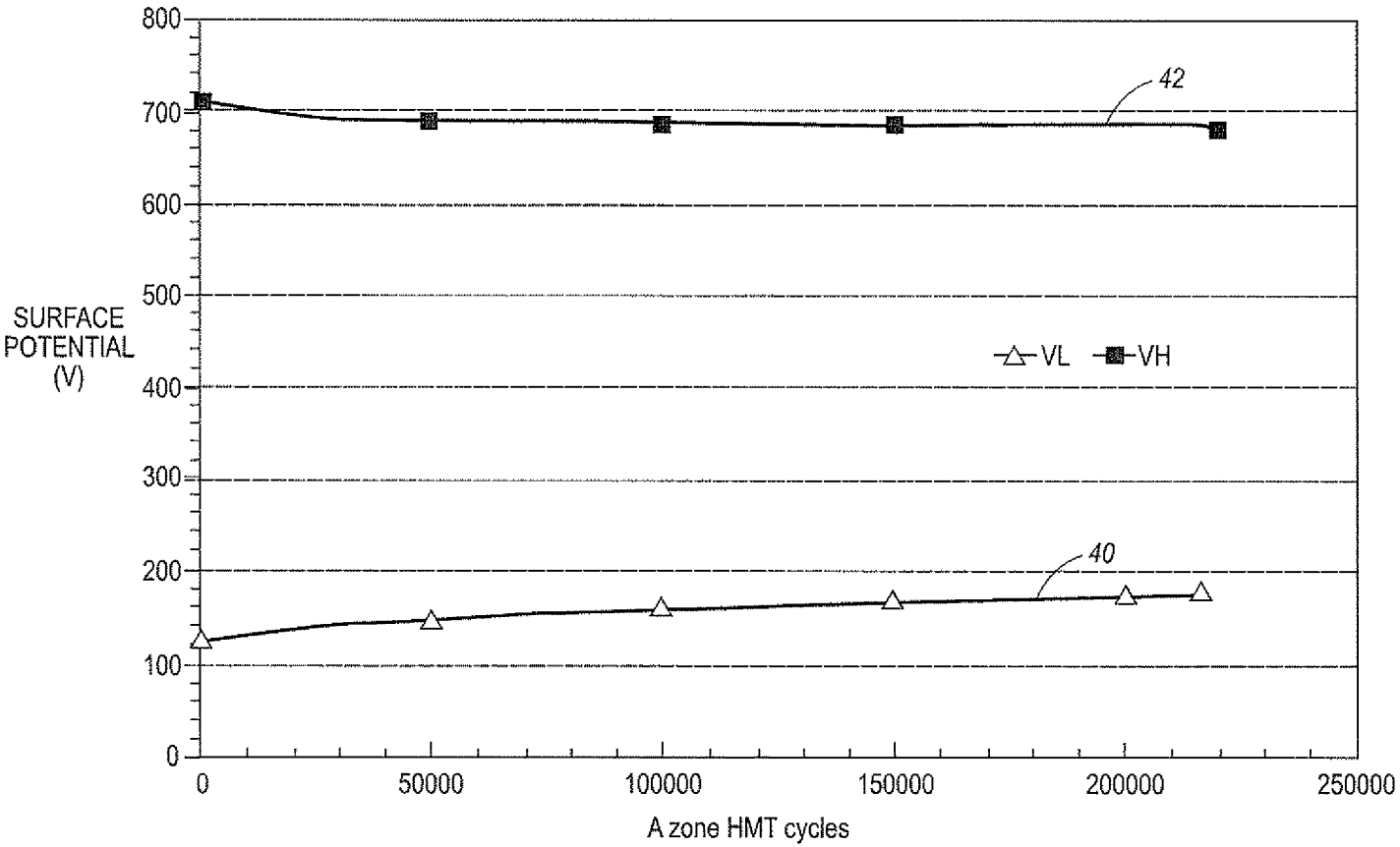
FIG. 4 illustrates a graph of photoconductor surface potentials in volts (V) versus the J zone HMT cycles where HMT refers to a known high speed Hyper Mode Test used to determine the xerographic cyclic stability of the photoconductors illustrated herein.

In FIG. 4, there is illustrated a graph of the surface potentials of the overcoated photoconductor of Example I, where line 40 designates $V_L$, and line 42 designates $V_H$. This graph illustrates the surface potentials in volts of from 0 to 800 versus the J zone (10 percent relative humidity and 70° F.) HMT cycles (photoconductor cyclic stability) of from 0 to 250,000 xerographic cycles, using a known in-house high-speed Hyper Mode Test (HMT). The HMT fixture rotated the drum photoconductor of Example I at 150 rpm under a Scoroton set to −700 volts. The drum photoconductor was then exposed to a LED erase lamp. Two voltage probes were positioned 90 degrees apart to measure $V_{high}$ ($V_H$) and $V_{residual}$ ($V_L$) starting at zero and up to a continuous 250,000 xerographic simulated cycles of charge/discharge/erase. The ozone generated during xerographic cycling was evacuated by an air pump and an ozone filter to simulate realistic xerographic machine printing environments.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor consisting of a supporting substrate, a hole blocking layer, an adhesive layer, a photogenerating layer, a charge transport layer of a charge transport compound, and a polyalkylene glycol benzoate, and an overcoat layer in contact with said charge transport layer, the overcoat layer consisting of a charge transport compound and a melamine resin and wherein said polyalkylene glycol benzoate is present in an amount of from about 0.1 to about 10 weight percent based on the weight percent of the components present in said charge transport layer and wherein said polyalkylene glycol benzoate is a mono-benzoate as represented by the following formulas/structures

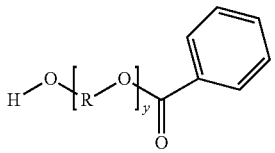

wherein R is an alkylene substituent, and y represents the number of repeating segments of from about 1 to about 10.

2. A photoconductor in accordance claim 1 wherein y is 1 and R is methylene, ethylene or propylene.

3. A photoconductor consisting of a supporting substrate, a photogenerating layer, and a charge transport layer of a charge transport compound and a polyalkylene glycol benzoate, and a crosslinked overcoat layer in contact with said charge transport layer, the overcoat layer consisting of a charge transport compound, a melamine resin selected from the group consisting of methylated melamine resins, methoxymethylated melamine resins, ethoxymethylated melamine resins, propoxymethylated melamine resins, butoxymethylated melamine resins, and hexamethylol melamine resins, and a hydroxyl terminated fluorinated additive, a hydroxyl silicone modified polyacrylate additive, or mixtures thereof and wherein said polyalkylene glycol benzoate is present in an amount of from about 0.1 to about 10 weight percent based on the weight percent of the components present in said charge transport layer which polyalkylene glycol benzoate is a mono-benzoate of the following formulas/structures wherein R is an alkylene substituent, and y represents the number of repeating segments of from about 1 to about 10

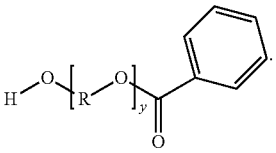

4. A photoconductor consisting of a photogenerating layer, a polyalkylene glycol mono-benzoate containing charge transport layer, and an overcoat layer in contact with said charge transport layer, the overcoat layer consisting of a charge transport compound and a melamine resin, and wherein said photoconductor possesses a ghosting grade of from about −2.5 to about zero and wherein said melamine resin is selected from the group consisting of methylated melamine resins, methoxymethylated melamine resins, ethoxymethylated melamine resins, propoxymethylated melamine resins, butoxymethylated melamine resins, hexamethylol melamine resins, and mixtures thereof, wherein the mono-benzoate is selected from the group consisting of methylene glycol benzoate, polypropylene glycol benzoate, polyethylene glycol benzoate, polybutylene glycol benzoate, polypentylene glycol benzoate, polyhexylene glycol benzoate, polyheptylene glycol benzoate, polyoctylene glycol benzoate, polynonylene glycol benzoate, and polydecylene glycol benzoate, and wherein the charge transport compound for the charge transport layer is represented by the following formulas/structures

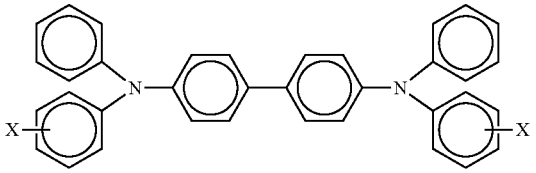

or

-continued

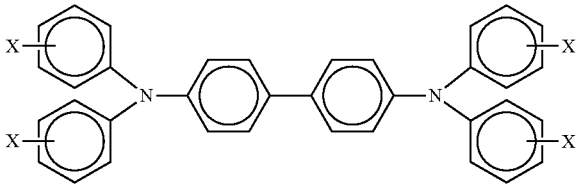

wherein X is selected from the group consisting of alkyl, alkoxy, aryl, halogen, and mixtures thereof.

5. A photoconductor in accordance with claim 4 wherein said charge transport compound is N,N'-diphenyl-N,N-bis(3-methylphenyl)-1,1'-biphenyl-4,4'-diamine and said mono-benzoate is methylene glycol benzoate, polypropylene glycol benzoate, or polyethylene glycol benzoate.

* * * * *